US012467336B2

(12) United States Patent
Mohamed Raffy et al.

(10) Patent No.: US 12,467,336 B2
(45) Date of Patent: Nov. 11, 2025

(54) TUBING PRESSURE INSENSITIVE SUBSURFACE SAFETY VALVE

(71) Applicant: Halliburton Energy Services, Inc., Houston, TX (US)

(72) Inventors: Mohamed Mohsen Mohamed Raffy, Singapore (SG); Agasthya Raghavan, Aberdeen (GB); Andrew James Kelbie, Carrollton, TX (US); Michael Linley Fripp, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/434,527

(22) Filed: Feb. 6, 2024

(65) Prior Publication Data

US 2025/0250880 A1 Aug. 7, 2025

(51) Int. Cl.
*E21B 34/08* (2006.01)
*E21B 34/10* (2006.01)

(52) U.S. Cl.
CPC ..... *E21B 34/08* (2013.01); *E21B 34/10* (2013.01)

(58) Field of Classification Search
CPC ..... E21B 34/08; E21B 34/10
See application file for complete search history.

(56) References Cited

U.S. PATENT DOCUMENTS 7,775,269 B2 8/2010 Dennistoun et al.
2001/0035220 A1 11/2001 Russell
2009/0188662 A1 7/2009 Casciaro et al.
2017/0074068 A1 3/2017 Kucera et al.
2020/0056714 A1 2/2020 Mailand et al.
2022/0003075 A1* 1/2022 Jackson ..... F16K 31/1226
2023/0041355 A1 2/2023 Brown et al.

FOREIGN PATENT DOCUMENTS

WO 2014126568 A1 8/2014
WO 2020036920 A1 2/2020

* cited by examiner

*Primary Examiner* — Tara Schimpf
*Assistant Examiner* — Lamia Quaim
(74) *Attorney, Agent, or Firm* — Scott Richardson; Parker Justiss, P.C.

(57) ABSTRACT

Provided is a subsurface safety valve. The subsurface safety valve, in one aspect, includes a tubular housing having a longitudinal opening, and one or more openings extending into the tubular housing. The subsurface safety valve, in one aspect, further includes a longitudinal valve positioned within the longitudinal opening. In accordance with one aspect, the longitudinal valve includes a first piston having a first piston surface area ($SA_{P1}$) and a second piston having a second piston surface area ($SA_{P2}$), the first piston surface area ($SA_{P1}$) and the second piston surface area ($SA_{P2}$) being substantially identical, as well as a fluid flow path extending within and along the longitudinal valve, the fluid flow path entering the longitudinal valve between a first longitudinal valve end and the first piston and exiting the longitudinal valve between a second longitudinal valve end and the second piston.

21 Claims, 8 Drawing Sheets

TUBING PRESSURE INSENSITIVE SUBSURFACE SAFETY VALVE

BACKGROUND

One or more subsurface safety valves are commonly installed as part of the tubing string within oil and gas wells to protect against unwanted communication of high pressure and high temperature formation fluids to the surface. These subsurface safety valves are designed to shut in production from the formation in response to a variety of abnormal and potentially dangerous conditions.

As these subsurface safety valves are built into the tubing string, these valves are typically referred to as tubing retrievable safety valves ("TRSV"). TRSVs are normally operated by hydraulic fluid pressure which is typically controlled at the surface and transmitted to the TRSV via a hydraulic fluid line. Hydraulic fluid pressure must be applied to the TRSV to place the TRSV in the open state. When hydraulic fluid pressure is lost, the TRSV will return to the closed state to prevent formation fluids from traveling therethrough. As such, TRSVs are fail safe valves.

As TRSVs are often subjected to years of service in severe operating conditions, failure of TRSVs may occur. For example, a TRSV in the closed state may leak. Alternatively, a TRSV in the closed state may not properly open. Because of the potential for disaster in the absence of a properly functioning TRSV, it is vital that the malfunctioning TRSV be promptly replaced or repaired.

As TRSVs are typically incorporated into the tubing string, removal of the tubing string to replace or repair the malfunctioning TRSV is required. As such, the costs associated with replacing or repairing the malfunctioning TRSV is quite high. It has been found, however, that a wireline retrievable safety valve ("WRSV") may be inserted inside the original TRSV and operated to provide the same safety function as the original TRSV. These insert valves are designed to be lowered into place from the surface (e.g., via wireline) and locked inside the original TRSV. This approach can be a much more efficient and cost-effective alternative to pulling the tubing string to replace or repair the malfunctioning TRSV.

BRIEF DESCRIPTION

Figure 1:
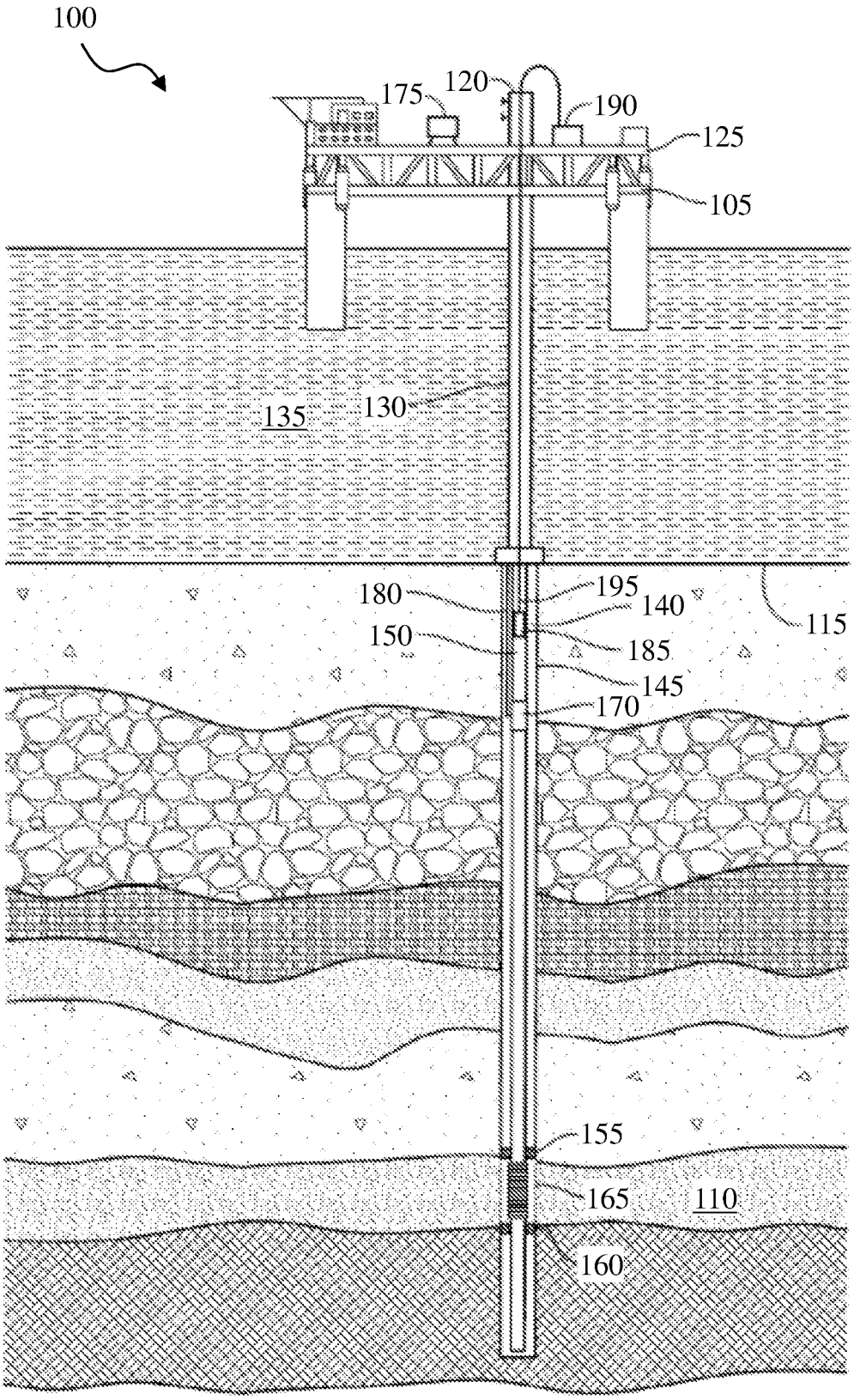
Figure 2:
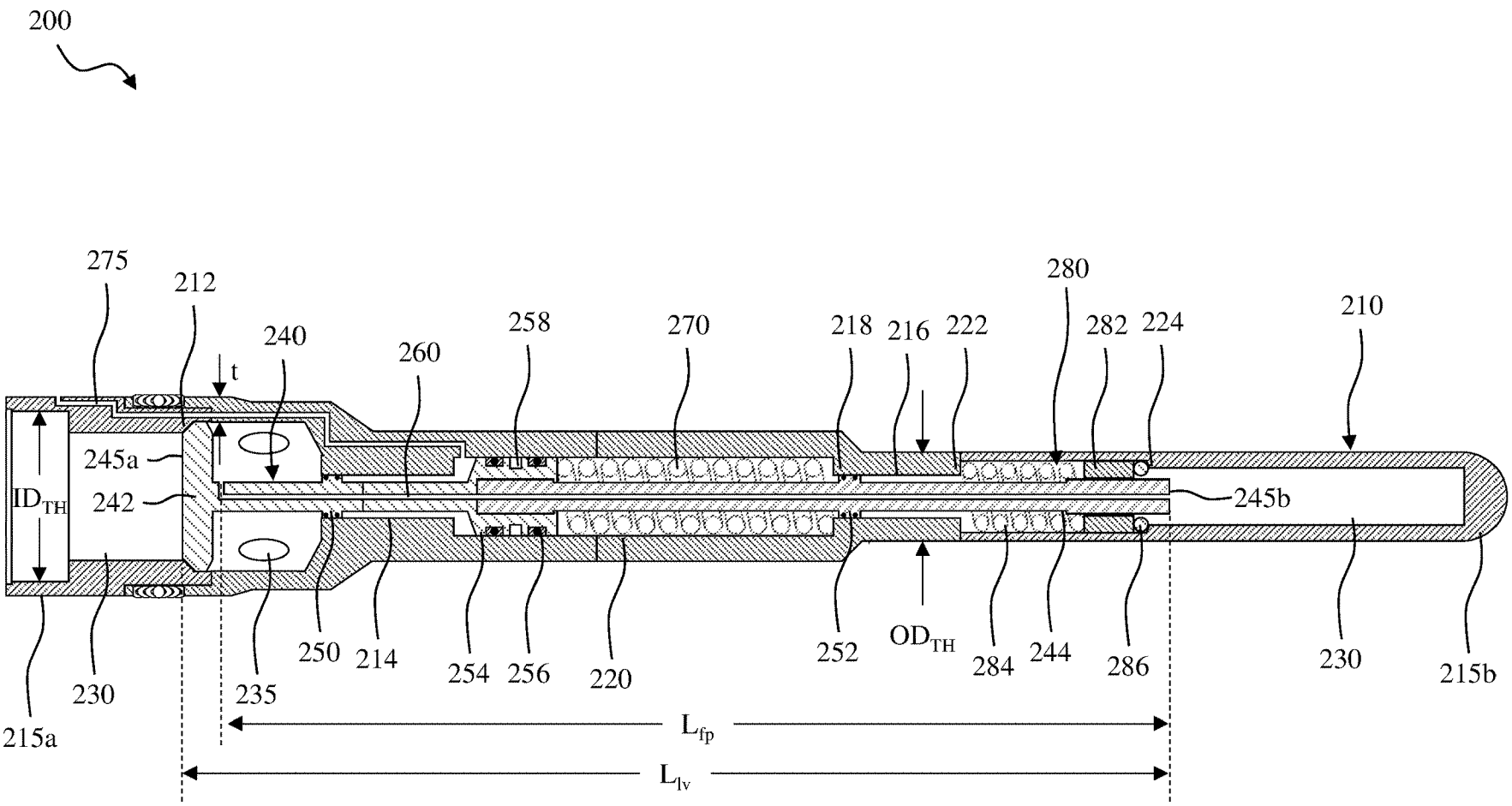

Reference is now made to the following descriptions taken in conjunction with the accompanying drawings, in which:

FIG. 1 illustrates a schematic view of a well system designed, manufactured and operated according to one or more embodiments disclosed herein;

FIG. 2 illustrates a cross-sectional view of one embodiment of a subsurface safety valve designed, manufactured and/or operated according to one or more embodiments of the disclosure; and FIGS. 3A through 5B illustrate cross-sectional views of different operational states of a subsurface safety valve designed, manufactured and/or operated according to one or more embodiments of the disclosure, for example positioned within a tubing retrievable safety valve.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Turning to FIG. 1, illustrated is a well system 100 designed, manufactured and/or operated according to one or more embodiments of the disclosure. The well system 100, in the illustrated embodiment, includes a semi-submersible platform 105 centered over a submerged subterranean formation 110 located below a sea floor 115. In the illustrated embodiment, a wellhead 120 is located on a deck 125 of the semi-submersible platform 105.

In the illustrated embodiment, a well 130 extends through the sea 135 and penetrates the various earth strata including the subterranean formation 110 to form a wellbore 140. Disposed within the wellbore 140, in the illustrated embodiment, is casing 145. In one or more embodiments, production tubing 150 is disposed within the casing 145, for example extending from the wellhead 120. In at least one embodiment, a pair of seal assemblies 155, 160 provides a seal between the production tubing 150 and the casing 145 to prevent the flow of production fluids therebetween. During production, formation fluids enter the wellbore 140 through perforations 165 in the casing 145 and travel into the production tubing 150 to the wellhead 120. In the illustrated embodiment, a tubing retrievable safety valve 170 is coupled within the production tubing 150.

In one or more embodiments, the tubing retrievable safety valve 170 is operated by hydraulic fluid pressure communicated thereto from a surface installation 175 and a hydraulic fluid control conduit 180. Hydraulic fluid pressure is applied to tubing retrievable safety valve 170 to place tubing retrievable safety valve 170 in the open state. When hydraulic fluid pressure is lost, the tubing retrievable safety valve 170 will automatically revert to the closed state to prevent formation fluids from traveling therethrough.

If, for example, the tubing retrievable safety valve 170 is unable to properly seal in the closed state or does not properly open after being in the closed state, the tubing retrievable safety valve 170 will typically be repaired or replaced. In the present disclosure, the functionality of tubing retrievable safety valve 170 is replaced by a wireline retrievable safety valve 185, which may be installed within tubing retrievable safety valve 170 via a wireline assembly 190 including a wireline 195. In at least one embodiment, once in place, the wireline retrievable safety valve 185 will be operated by hydraulic fluid pressure communicated thereto from surface installation 175 and hydraulic fluid line 180 through tubing retrievable safety valve 170. As with the original configuration of the tubing retrievable safety valve 170, the hydraulic fluid pressure may be applied to the wireline retrievable safety valve 185 to place wireline retrievable safety valve 185 in the open state. If hydraulic fluid pressure is lost, the wireline retrievable safety valve 185 will revert to the closed state to prevent formation fluids from traveling therethrough.

Even though FIG. 1 depicts a cased vertical well, it should be noted by one skilled in the art that the present invention is equally well-suited for uncased wells, deviated wells or horizontal wells. Also, even though FIG. 1 depicts an offshore operation, it should be noted by one skilled in the art that the present invention is equally well-suited for use in onshore operations.

Given the foregoing, the present disclosure has recognized that traditional subsurface safety valves, including the wireline retrievable safety valve, have certain drawbacks. For example, the present disclosure has recognized that traditional subsurface safety valves have difficulty operating (e.g., opening and closing) when the hydrostatic pressure within the wellbore is high. For example, when the hydrostatic pressure is high, such as in very deep wells, the hydraulic fluid pressure required to overcome this significant hydrostatic pressure within the wellbore, and thus open and close the traditional subsurface safety valves, is also high. Accordingly, the present disclosure has developed a subsurface safety valve that is insensitive to tubing pressure, and thus insensitive to the significant hydrostatic pressure discussed above, and thus is one that can be operated with much lower hydraulic control line pressures.

Turning to FIG. 2, illustrated is a cross-sectional view of a subsurface safety valve 200 designed, manufactured and/or operated according to one or more embodiments of the disclosure. In the embodiment of FIG. 2, the subsurface safety valve 200 is configured as a wireline retrievable safety valve, for example as might be insert within a defective tubing retrievable safety valve. Nevertheless, other embodiments may exist wherein the subsurface safety valve 200 is a valve other than a wireline retrievable safety valve.

The subsurface safety valve 200, in the illustrated embodiment, includes a tubular housing 210. The tubular housing 210, in at least one embodiment, is a metal tubular housing having a first tubular housing end 215*a*, and a second tubular housing end 215*b*. The tubular housing 210, in at least the embodiment of FIG. 2, additionally includes a longitudinal opening 230 extending at least partially from the first tubular housing end 215*a* toward the second tubular housing end 215*b*. For example, in at least one embodiment the longitudinal opening 230 extends only partially from the first tubular housing end 215*a* toward the second tubular housing end 215*b*, and thus the tubular housing 210 is closed at the second tubular housing end 215*b*. In the illustrated embodiment of FIG. 2, the tubular housing 210 has an inside diameter ($ID_{TH}$), an outside diameter ($OD_{TH}$), and a wall thickness (t).

The subsurface safety valve 200, in the illustrated embodiment, further includes one or more openings 235 extending through the wall thickness (t). In at least one or more embodiments, the one or more openings 235 extend through the wall thickness (t) proximate the first tubular housing end 215*a*, and thus may provide a fluid path for wellbore fluids to flow into and through the tubular housing 210 and uphole into a production tubular (not shown). The one or more openings 235 may include a variety of different sizes, shapes and numbers and remain within the scope of the present disclosure. Nevertheless, in the illustrated embodiment, the one or more openings 235 are four or more scalloped openings. In one or more alternative embodiments, the one or more openings 235 may include a hardened surface (e.g., hard facing) thereon. The hard facing process may include depositing a layer of robust materials (e.g., RCoCr-A, ERC0Cr-A, etc., without limitation) to improve erosion resistance.

The one or more openings 235, in one or more embodiments, are a series of radially aligned openings, such as shown. In yet another embodiment (e.g., not shown), the one or more openings 235 are axially aligned. When axially aligned, as discussed, less erosion may occur. Similarly, the series of axially aligned openings can be decreasing in diameter in the flow direction. In yet another embodiment, the one or more openings 235 are axially and radially aligned. Similarly, the one or more openings 235 may be at an angle so that the flow swirls within the tubular opening 230. The swirl allows for cleaning sand and other debris away from the longitudinal valve 240. The swirl also discourages scale from sticking to the inside walls of the tubular housing 210.

The subsurface safety valve 200, in accordance with one embodiment, further includes a longitudinal valve 240 (e.g., poppet valve, which allows for a shorter sealing section, which is shorter and cheaper) positioned within the longitudinal opening 230. In the illustrated embodiment, the longitudinal valve 240 includes a first longitudinal valve end 245*a* and a second longitudinal valve end 245*b*. Further to the embodiment of FIG. 2, the longitudinal valve 240 is configured to move between a closed state preventing the one or more openings 235 from providing the fluid path for wellbore fluids to flow into and through the tubular housing 210 and uphole into the production tubular (e.g., as shown in FIG. 2), and an open state allowing the one or more openings 235 to provide the fluid path for the wellbore fluids to flow into and through the tubular housing 210 and uphole into the production tubular (e.g., not shown in FIG. 2). For example, when the longitudinal valve 240 is in the closed state a T-portion 242 of the longitudinal valve 240 engages with a shoulder 212 of the tubular housing 210 to form a seal (e.g., metal-to-metal seal). In contrast, when the longitudinal valve 240 is in the open state, the T-portion 242 fails to engage with the shoulder 212 of the tubular housing 210, and thus allows the wellbore fluids to flow into and through the tubular housing 210 and uphole into the production tubular.

The longitudinal valve 240, in one or more embodiments, is a unique design that allows for the subsurface safety valve 200 to be insensitive to tubing pressure. For example, in at least one embodiment, the longitudinal valve 240 includes a first piston 250 having a first piston surface area ($SA_{P1}$), the first piston 250 located more proximate the first longitudinal valve end 245*a* than the second longitudinal valve end 245*b*. In accordance with this embodiment, the first piston 250 is configured to slide upon a first piston surface 214 of the tubular housing 210 as the longitudinal valve 240 moves between the closed state and the open state. In accordance with this one embodiment, the longitudinal valve 240 additionally includes a second piston 252 having a second piston surface area ($SA_{P2}$), the second piston 252 located more near the second longitudinal valve end 245*b* than the first longitudinal valve end 245*a*. In this embodiment, the second piston 252 is configured to slide upon a second piston surface 216 of the tubular housing 210 as the longitudinal valve 240 moves between the closed state and the open state.

In one or more embodiments, the first piston surface area ($SA_{P1}$) and the second piston surface area ($SA_{P2}$) are substantially identical. The term "substantially identical," as used herein, means that the first piston surface area ($SA_{P1}$) and the second piston surface area ($SA_{P2}$) are within 20 percent of one another. In yet another embodiment, the first piston surface area ($SA_{P1}$) and the second piston surface area ($SA_{P2}$) are significantly identical. The term "significantly identical," as used herein, means that the first piston surface area ($SA_{P1}$) and the second piston surface area ($SA_{P2}$) are within 10 percent of one another. In yet another embodiment, the first piston surface area ($SA_{P1}$) and the second piston surface area ($SA_{P2}$) are ideally identical. The term "ideally identical," as used herein, means that the first piston surface area ($SA_{P1}$) and the second piston surface area ($SA_{P2}$) are within 5 percent of one another. In yet another embodiment, the first piston surface area ($SA_{P1}$) and the second piston surface area ($SA_{P2}$) are perfectly identical. The term "perfectly identical," as used herein, means that the first piston surface area ($SA_{P1}$) and the second piston surface area ($SA_{P2}$) are within 2 percent of one another. In even yet another embodiment, the first piston surface area ($SA_{P1}$) and the second piston surface area ($SA_{P2}$) are exactly identical. The term "exactly identical," as used herein, means that the first piston surface area ($SA_{P1}$) and the second piston surface area ($SA_{P2}$) are within 0.5 percent of one another.

The subsurface safety valve 200, in one or more embodiments, additionally includes a fluid flow path 260 extending within and along the longitudinal valve 240. In one or more embodiments, the fluid flow path 260 enters the longitudinal valve 240 between the first longitudinal valve end 245*a* and the first piston 250, and exits the longitudinal valve 240 between the second longitudinal valve end 245*b* and the second piston 252. For example, in one or more embodiments, the fluid flow path 260 also enters the longitudinal valve 240 upstream of a point where the fluid enters the subsurface safety valve at the one or more openings 235.

The fluid flow path 260, in one or more embodiments, has a length ($L_{fp}$) that extends along a significant portion of a length ($L_{lv}$) of the longitudinal valve 240. For example, in at least one embodiment, the length ($L_{fp}$) is at least 25 percent of the length ($L_{lv}$). In yet another embodiment, the length ($L_{fp}$) is at least 50 percent of the length ($L_{lv}$), if not at least 75 percent. In yet another embodiment, the length ($L_{fp}$) is at least 85 percent of the length ($L_{lv}$), and for example exits the longitudinal valve 260 at the second longitudinal valve end 245*b*. The subsurface safety valve 200 benefits greatly from the aforementioned length ($L_{fp}$), in that the length ($L_{fp}$) provides resistance as the fluid travels from the first longitudinal valve end 245*a* to the second longitudinal valve end 245*b*, and vice versa, and thus provides an anti-chatter effect as the longitudinal valve 240 encounters changing pressures.

The fluid flow path 260 through the center of the longitudinal valve 240 may help serve as a hydraulic damper for chattering of the longitudinal valve 240. The length (Lip) of the fluid flow path 260 adds fluid resistance that will help to minimize the oscillations, as the flow needs to be pushed through the fluid flow path 260 as the longitudinal valve 240 moves between its closed state and its open state.

The subsurface safety valve 200, in the illustrated embodiment, additionally includes a power spring 270 located within the longitudinal opening 230. In one or more embodiments, the power spring 270 engages a radially extending portion 254 of the longitudinal valve 240 and a power spring shoulder 218 of the tubular housing 210. Accordingly, in this embodiment the power spring 270 is configured to urge the longitudinal valve 240 toward the closed state. In the illustrated embodiment of FIG. 2, the radially extending portion 254 is a third piston have a third piston surface area ($SA_{P3}$), the third piston located between the first piston 250 and the second piston 252. The radially extending portion 254, which in this embodiment is configured as the third piston, is configured to slide upon a third piston surface 220 of the tubular housing 210 as the longitudinal valve 240 moves between the closed state and the open state.

In one or more embodiments, the radially extending portion 254 includes one or more seals 256 that seal against the third piston surface 220. In yet another embodiment, the radially extending portion 254 additionally includes a groove 258 between pairs of the one or more seals 256. In at least one embodiment, this groove 258 is filled with a non-flammable, highly viscous, immiscible and highly inert fluid, such as Dow Corning Silicone Oil 350 CS or likewise. The fluid in the groove 258, in one or more embodiments, acts as an additional liquid barrier against the leakage of gases (pressure loss).

In accordance with one or more embodiments, the third piston surface area ($SA_{P3}$) is greater than the first piston surface area ($SA_{P1}$) and the second piston surface area ($SA_{P2}$). For example, in one or more embodiments, the third piston surface area ($SA_{P3}$) is at least 25 percent greater than the first piston surface area ($SA_{P1}$) and the second piston surface area ($SA_{P2}$), if not at least 50 percent greater than the first piston surface area ($SA_{P1}$) and the second piston surface area ($SA_{P2}$). In yet another embodiment, the third piston surface area ($SA_{P3}$) is at least 100 percent greater than the first piston surface area ($SA_{P1}$) and the second piston surface area ($SA_{P2}$). As will be understood further below, unless otherwise stated, the third piston surface area ($SA_{P3}$) need not be any specific value greater than the first piston surface area ($SA_{P1}$) and the second piston surface area ($SA_{P2}$). Accordingly, the third piston surface area ($SA_{P3}$) may be at least 5 percent, 10 percent, 15 percent, 20 percent, 25 percent, 30 percent, 35 percent, 40 percent, 45 percent, 50 percent, percent, 60 percent, 65 percent, 70 percent, 75 percent, 80 percent, 85 percent, 90 percent, 95 percent, or more, greater than the first piston surface area ($SA_{P1}$) and the second piston surface area ($SA_{P2}$). The greater a value between the third piston surface area ($SA_{P3}$) and the first piston surface area ($SA_{P1}$) and the second piston surface area ($SA_{P2}$), the less pressure is required to move the longitudinal valve 240 from the closed state to the open state.

In accordance with one or more embodiments, the subsurface safety valve 200 may further include a control line opening 275 extending at least partially along and through the wall thickness (t) of the tubular housing 210. In the disclosed embodiment, the control line opening 275 enters the longitudinal opening 230 between the first piston 250 and the third piston, and is configured to provide control line pressure to the radially extending portion 254 (e.g., third piston) to oppose the power spring 270 and move the longitudinal valve 240 between the closed state and the open state.

The control line opening 275, in one or more embodiments, is configured to receive control line pressure from a surface of the wellbore. For example, if the tubing retrievable safety valve is unable to properly seal in the closed state or does not properly open after being in the closed state, the functionality of tubing retrievable safety valve may be replaced by the subsurface safety valve 200, which may be installed within tubing retrievable safety valve via a wireline. In at least one embodiment, once in place, the subsurface safety valve 200 will be operated by hydraulic fluid pressure communicated thereto from a surface installation and hydraulic fluid line through tubing retrievable safety valve, and into the control line opening 275. For example, when the subsurface safety valve 200 is insert within the tubing retrievable safety valve, the subsurface safety valve 200 may puncture the control line signal of the tubing retrievable safety valve and redirect it to the subsurface safety valve 200.

The subsurface safety valve 200, in one or more embodiments, may further include a detent mechanism 280 positioned within the longitudinal tubular 230 proximate where the fluid flow path 260 exits the longitudinal valve 240. In one or more embodiments, the detent mechanism 280 is configured to releasably hold the longitudinal valve 240 in the open state. The detent mechanism 280 may include a variety of different features and remain within the scope of the disclosure. Nevertheless, in at least one embodiment, the detent mechanism 280 includes a detent spacer 282, a detent spring 284 positioned between the detent spacer 282 and a first detent shoulder 222 of the tubular housing 210, and one or more detent balls 286 slidable coupled with the detent spacer 282. In one or more embodiments, the one or more detent balls 286 are configured to: 1) remain within a first axial and first radial position engaged with a second detent shoulder 224 of the tubular housing 210 when the longitudinal valve 240 is the in the closed state; 2) ride upon the longitudinal valve 240 as the longitudinal valve 240 moves from the closed state to the open state while remaining within the first axial and first radial position engaged with the second detent shoulder 224 of the tubular housing 210; and 3) release from the second detent shoulder 224 and move to a second different axial and second different radial position engaged with a smaller outside diameter of the longitudinal valve 240 when the longitudinal valve 240 reaches the open state. In accordance with this embodiment, when in the third position, the one or more detent balls 286 engage with the smaller outside diameter 244 of the longitudinal valve 240 to releasably hold the longitudinal valve 240 in the open state.

Hysteresis may be created with the detent mechanism 280 (e.g., spring loaded detent mechanism 280). This hysteresis, in force, should minimize the likelihood of chatter. The mechanical anti-chatter may be the spring loaded one or more detent balls 286, or alternatively a collet or other similar design.

Turning now to FIGS. 3A through 5B, illustrated are cross-sectional views of different operational states of a subsurface safety valve 300 designed, manufactured and/or operated according to one or more embodiments of the disclosure, for example positioned within a tubing retrievable safety valve 390. The subsurface safety valve 300 of FIGS. 3A through 5B is similar in many respects to the subsurface safety valve 200 of FIG. 2. Accordingly, like reference numbers have been used to indicate similar, if not identical, features.

Figure 3A:
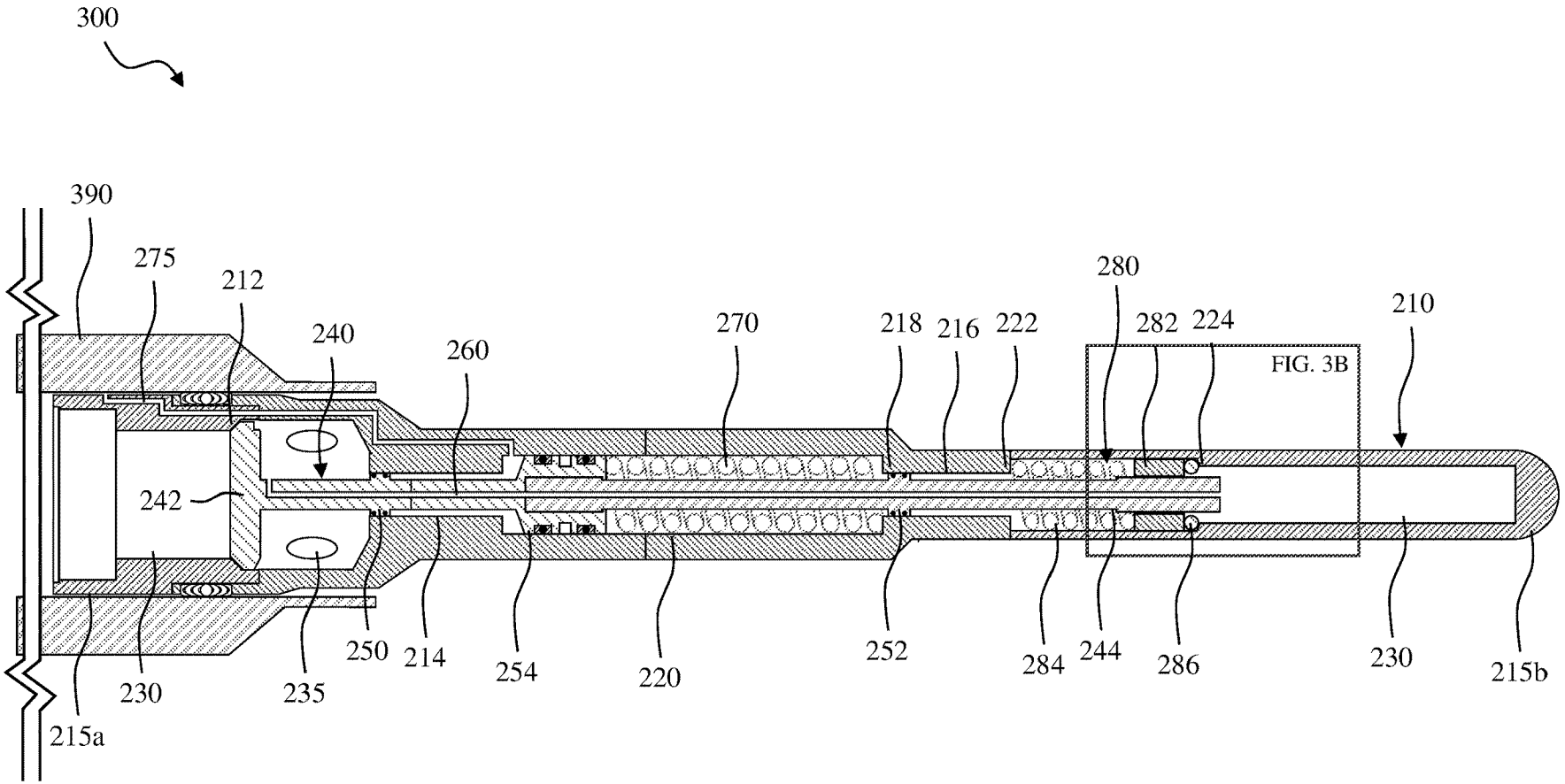
Figure 3B:
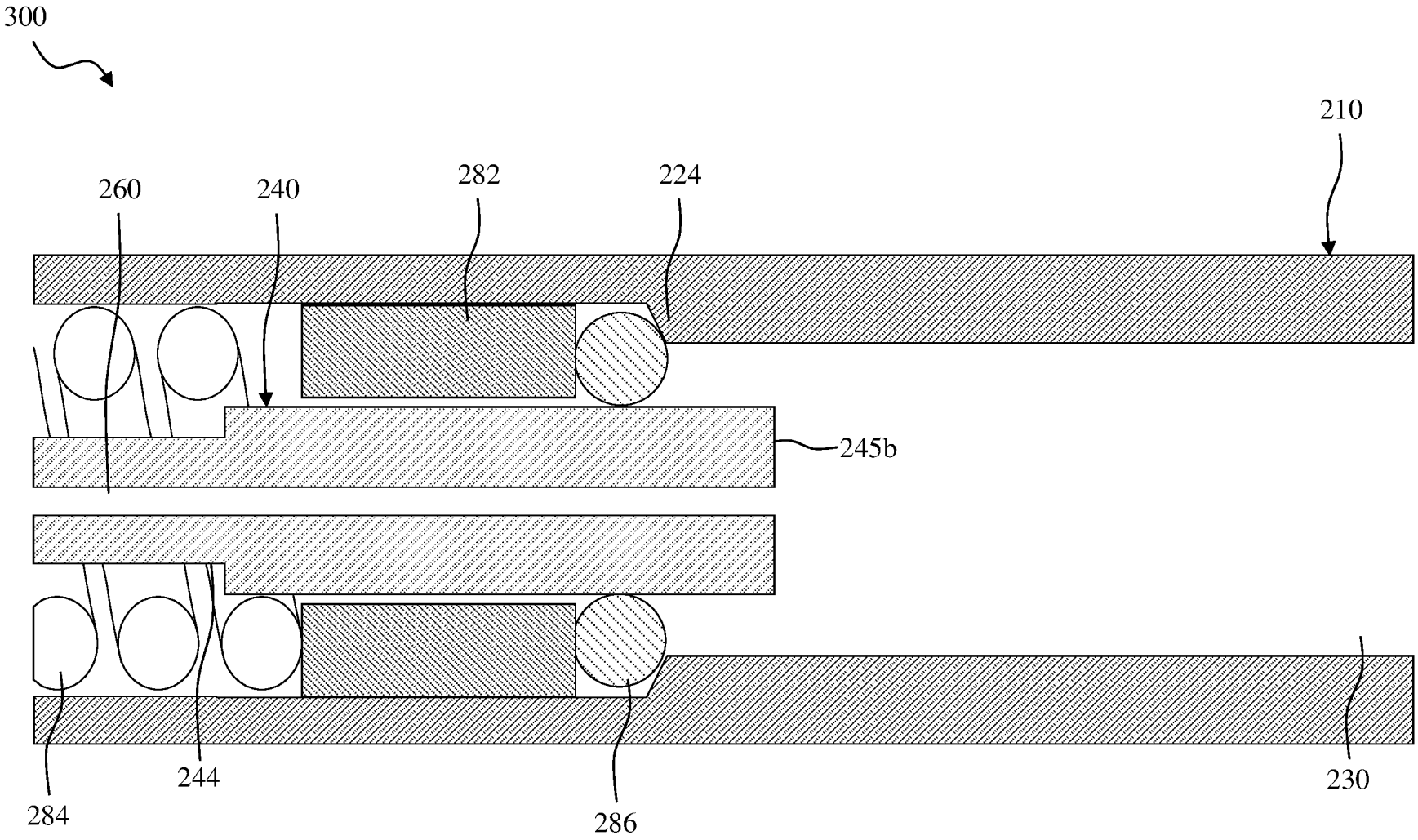

Turning to FIGS. 3A and 3B, the subsurface safety valve 300 is illustrated in the closed state (e.g., fully closed state). Accordingly, the T-shaped portion 242 of the longitudinal valve 240 is engaged with the shoulder 212 of the tubular housing 210, and thus prevents any fluids that may have entered the subsurface safety valve 300 via the one or more openings 235 from travelling uphole past the longitudinal valve 240. Moreover, at this stage, the fluid from the wellbore has entered the longitudinal opening 230 via the one or more openings 235, and has travelled through the fluid flow path 260, and thus is located on opposing sides of the first piston 250 and the second piston 252. As the same fluid, for example having the same fluid pressure, is located on both sides of the first piston 250 and the second piston 255 (e.g., the first piston surface area ($SA_{P1}$) and the second piston surface area ($SA_{P2}$) being substantially identical), the longitudinal valve 240 is insensitive to tubing pressure. Furthermore, at this stage of operation the detent mechanism 280 is at its disengaged state. Accordingly, the one or more detent balls 286 remain within a first axial and first radial position engaged with a second detent shoulder 224 of the tubular housing 210.

Figure 4A:
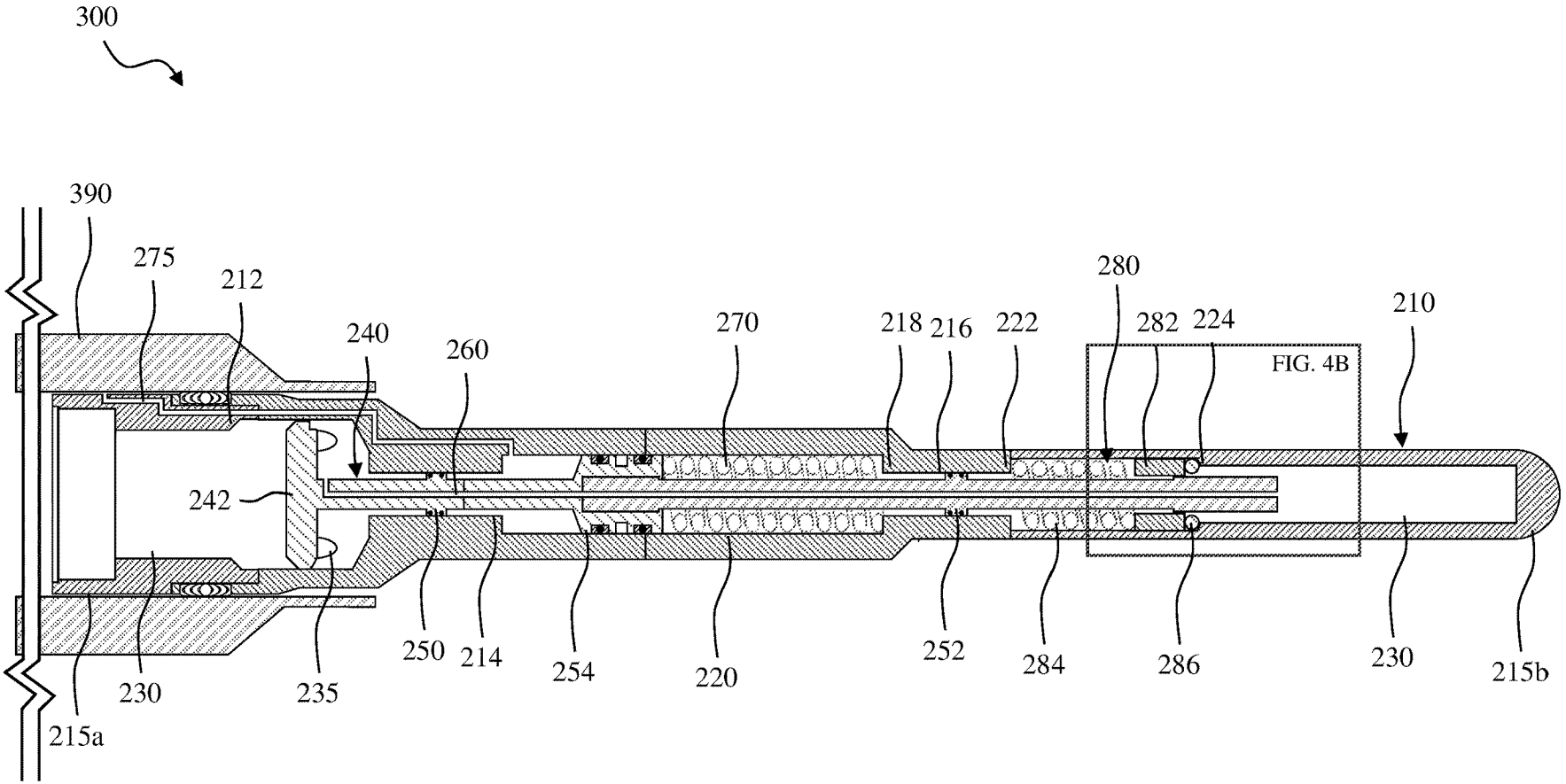
Figure 4B:
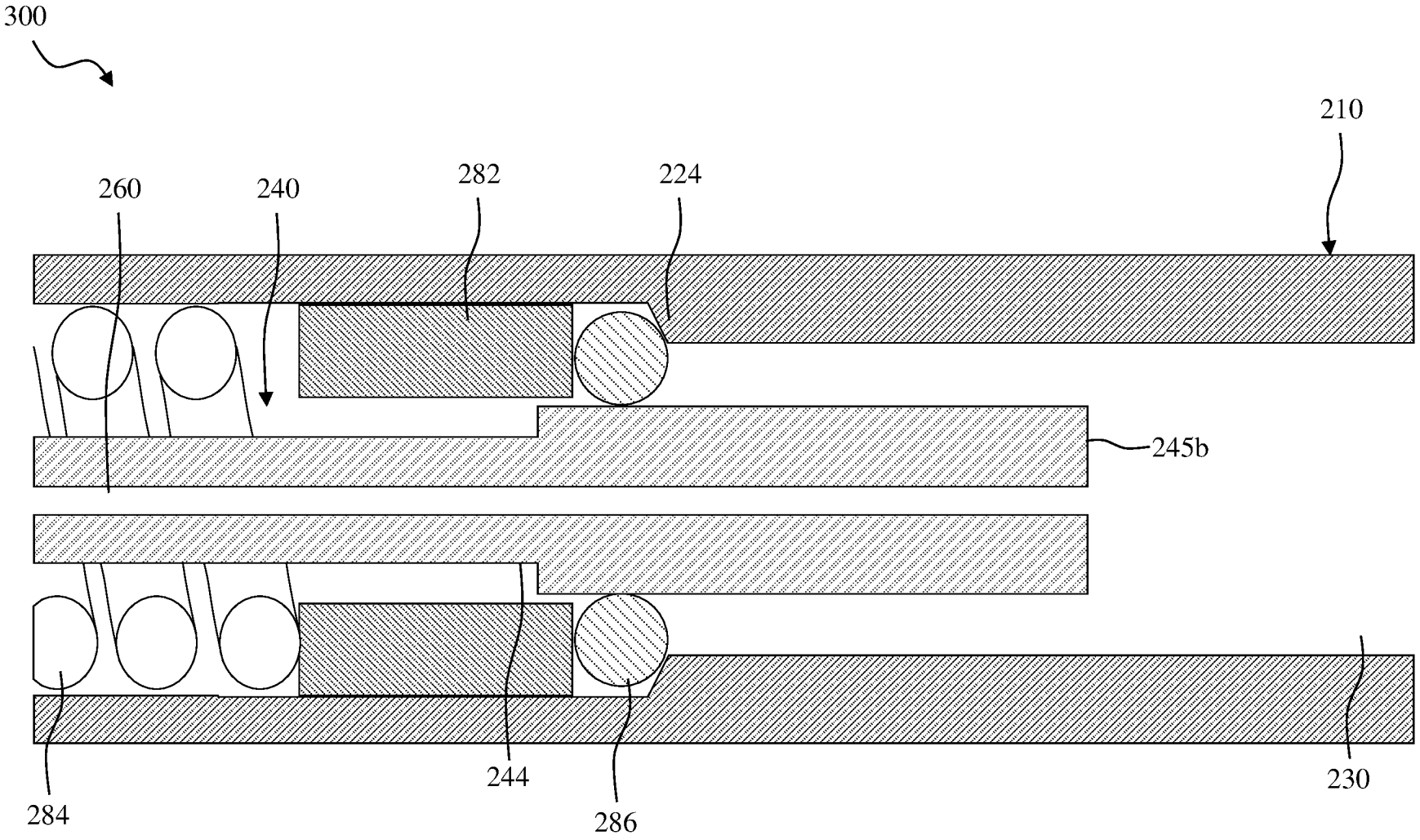
Figure 5A:
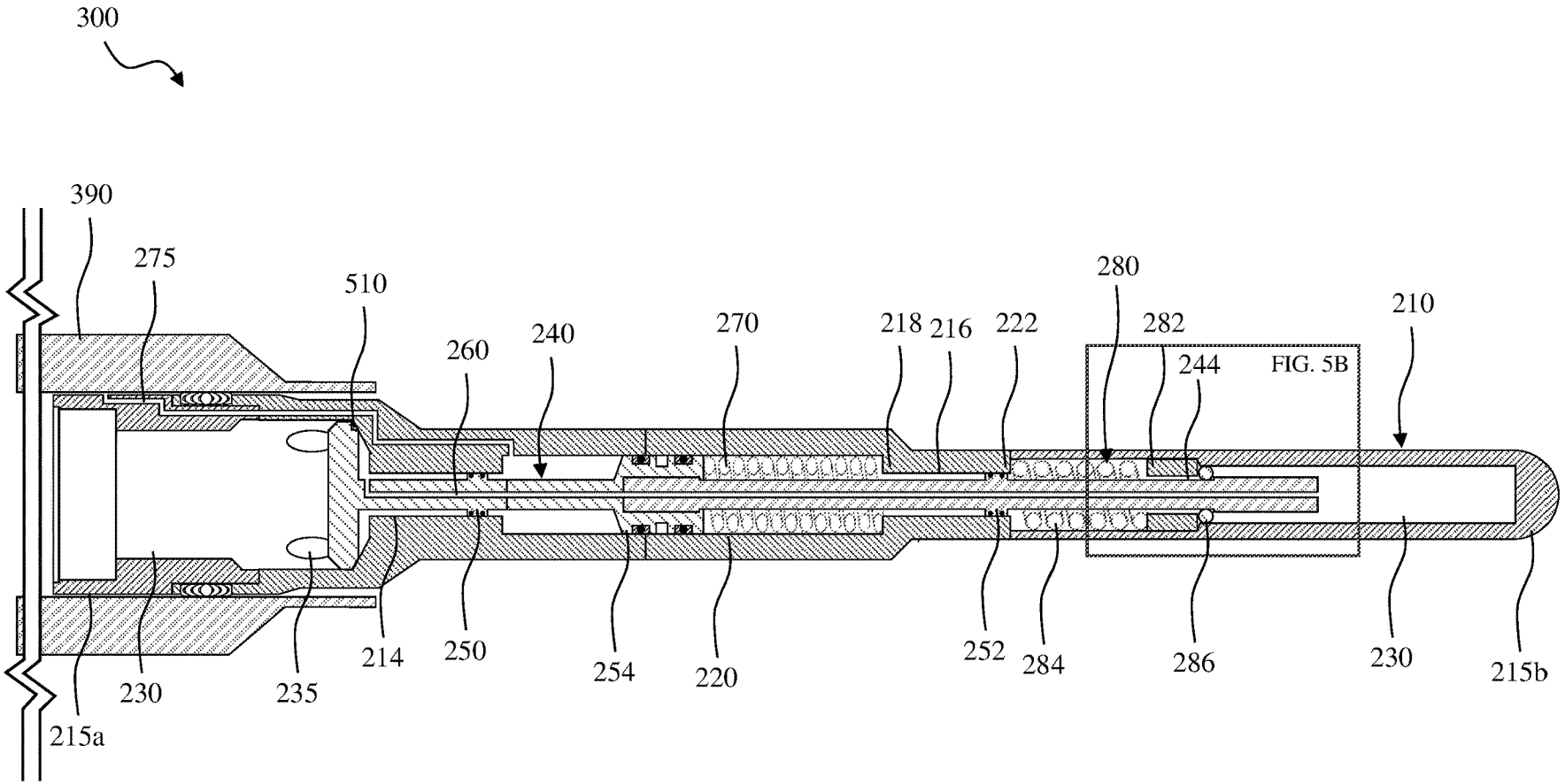
Figure 5B:
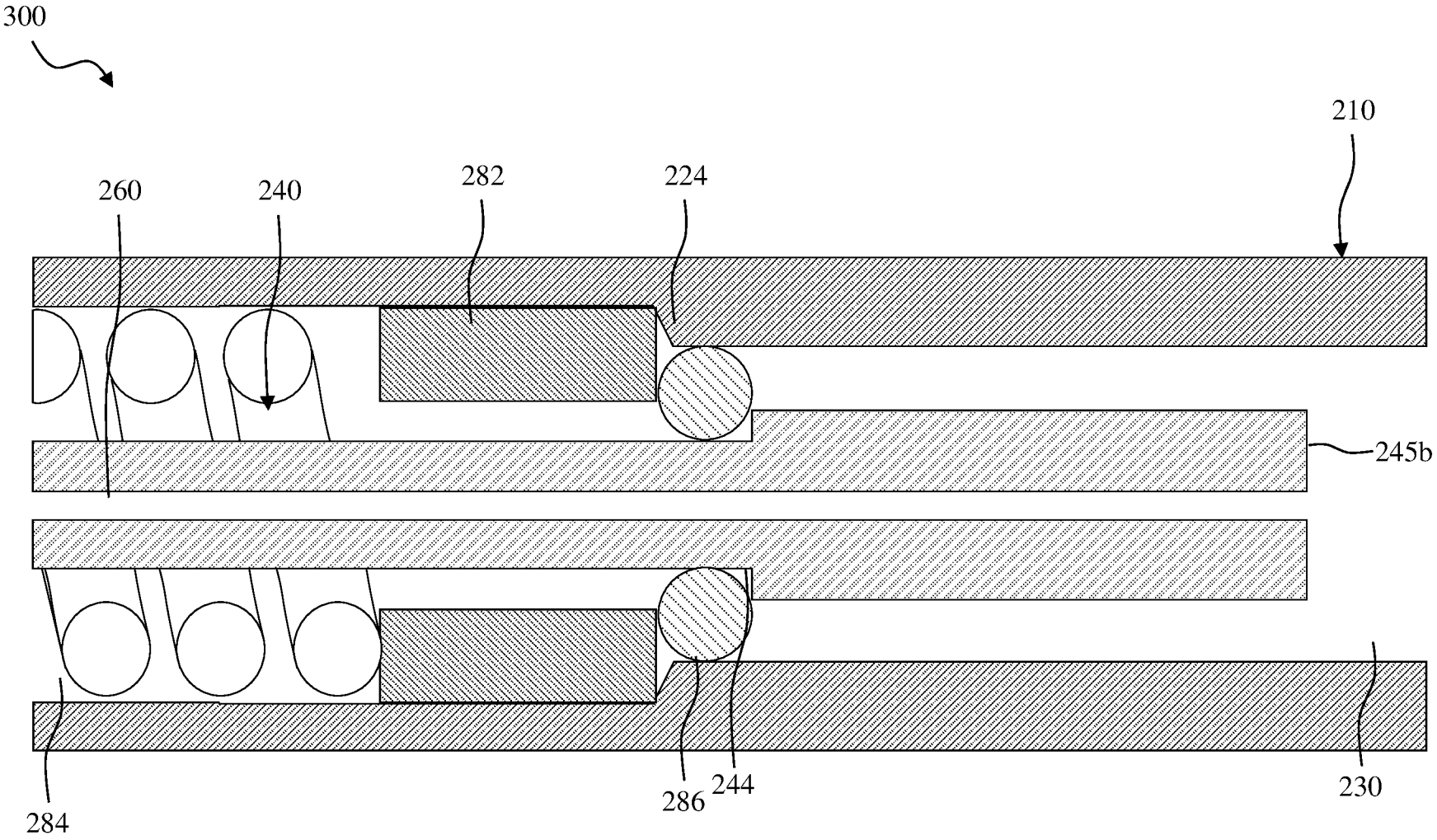

Turning to FIGS. 4A and 4B, the subsurface safety valve 300 is illustrated in between the fully closed state (e.g., of FIGS. 3A and 3B) and the fully open state (e.g., of FIGS. 5A and 5B). This state may be achieved by applying a control fluid signal to the longitudinal valve 240 (e.g., pumping control line pressure from the surface of the wellbore into the longitudinal tubular 230 between the first piston 250 and the radially extending portion 254 (e.g., third piston)) to overcome the spring force of the power spring 270. In accordance with one embodiment of the disclosure, the control fluid signal is insensitive to the tubing pressure, for example as a result of the first piston surface area ($SA_{P1}$), the second piston surface area ($SA_{P2}$), and the fluid flow path 260.

Furthermore, at this stage of operation the detent mechanism 280 is still at its disengaged state. Accordingly, while the one or more detent balls 286 may ride upon the longitudinal valve 240 as the longitudinal valve 240 moved from the closed state to the open state, the one or more detent balls 286 remain within the first axial and first radial position engaged with the second detent shoulder 224 of the tubular housing 210.

Turning to FIGS. 5A and 5B, the subsurface safety valve 300 is illustrated in the open state (e.g., fully open state). Accordingly, the T-shaped portion 242 of the longitudinal valve 240 has disengaged from the shoulder 212 of the tubular housing 210, and thus allows fluids that may have entered the subsurface safety valve 300 via the one or more openings 235 to travel uphole past the longitudinal valve 240. This state may be achieved by applying a control fluid signal to the longitudinal valve 240 (e.g., pumping control line pressure from the surface of the wellbore into the longitudinal tubular 230 between the first piston 250 and the radially extending portion 254 (e.g., third piston)) to overcome the spring force of the power spring 270. Again, in accordance with one embodiment of the disclosure, the control fluid signal is insensitive to the tubing pressure, for example as a result of the first piston surface area ($SA_{P1}$), the second piston surface area ($SA_{P2}$), and the fluid flow path.

The subsurface safety valve 300 of FIGS. 5A and 5B may additionally include a flow port/groove 510 across a seat of the T-shaped portion 242. The flow port/groove 510 may take on many different designs (e.g., shapes, sizes, locations), and allows the production fluids to enter the fluid flow path 260 when the longitudinal valve 240 is in the fully open state.

Furthermore, the detent mechanism 280 is now in its engaged state. Accordingly, the one or more detent balls 286 have released from the second detent shoulder 224 and have moved to a second different axial and second different radial position engaged with a smaller outside diameter 244 of the longitudinal valve 240. Accordingly, the one or more detent balls 286 engage with the smaller outside diameter 244 of the longitudinal valve 240 to releasably hold the longitudinal valve in the open state.

Aspects disclosed herein include:

A. A subsurface safety valve, the subsurface safety valve including: 1) a tubular housing having a first tubular housing end, a second tubular housing end, and a longitudinal opening extending at least partially from the first tubular housing end toward the second tubular housing end, the tubular housing having an inside diameter, an outside diameter, and a wall thickness (t); 2) one or more openings extending through the wall thickness (t) proximate the first tubular housing end, the one or more openings configured to provide a fluid path for wellbore fluids to flow into and through the tubular housing and uphole into a production tubular; and 3) a longitudinal valve having a first longitudinal valve end and a second longitudinal valve end positioned within the longitudinal opening, the longitudinal valve configured to move between a closed state preventing the one or more openings from providing the fluid path for wellbore fluids to flow into and through the tubular housing and uphole into the production tubular and an open state allowing the one or more openings to provide the fluid path for the wellbore fluids to flow into and through the tubular housing and uphole into the production tubular, the longitudinal valve including: a) a first piston having a first piston surface area ($SA_{P1}$), the first piston located more proximate the first longitudinal valve end than the second longitudinal valve end and configured to slide upon a first piston surface of the tubular housing as the longitudinal valve moves between the closed state and the open state; b) a second piston having a second piston surface area ($SA_{P2}$), the second piston located more near the second longitudinal valve end than the first longitudinal valve end and configured to slide upon a second piston surface of the tubular housing as the longitudinal valve moves between the closed state and the open state, the first piston surface area ($SA_{P1}$) and the second piston surface area ($SA_{P2}$) being substantially identical; and c) a fluid flow path extending within and along the longitudinal valve, the fluid flow path entering the longitudinal valve between the first longitudinal valve end and the first piston and exiting the longitudinal valve between the second longitudinal valve end and the second piston, the first piston surface area ($SA_{P1}$), the second piston surface area ($SA_{P2}$), and the fluid flow path making the longitudinal valve insensitive to tubing pressure.

B. A well system, the well system including: 1) a wellbore extending through one or more subterranean formations; and 2) a subsurface safety valve located in the wellbore, the subsurface safety valve including: a) a tubular housing having a first tubular housing end, a second tubular housing end, and a longitudinal opening extending at least partially from the first tubular housing end toward the second tubular housing end, the tubular housing having an inside diameter, an outside diameter, and a wall thickness (t); b) one or more openings extending through the wall thickness (t) proximate the first tubular housing end, the one or more openings configured to provide a fluid path for wellbore fluids to flow into and through the tubular housing and uphole into a production tubular; and c) a longitudinal valve having a first longitudinal valve end and a second longitudinal valve end positioned within the longitudinal opening, the longitudinal valve configured to move between a closed state preventing the one or more openings from providing the fluid path for wellbore fluids to flow into and through the tubular housing and uphole into the production tubular and an open state allowing the one or more openings to provide the fluid path for the wellbore fluids to flow into and through the tubular housing and uphole into the production tubular, the longitudinal valve including: i) a first piston having a first piston surface area ($SA_{P1}$), the first piston located more proximate the first longitudinal valve end than the second longitudinal valve end and configured to slide upon a first piston surface of the tubular housing as the longitudinal valve moves between the closed state and the open state; ii) a second piston having a second piston surface area ($SA_{P2}$), the second piston located more near the second longitudinal valve end than the first longitudinal valve end and configured to slide upon a second piston surface of the tubular housing as the longitudinal valve moves between the closed state and the open state, the first piston surface area ($SA_{P1}$) and the second piston surface area ($SA_{P2}$) being substantially identical; and iii) a fluid flow path extending within and along the longitudinal valve, the fluid flow path entering the longitudinal valve between the first longitudinal valve end and the first piston and exiting the longitudinal valve between the second longitudinal valve end and the second piston, the first piston surface area ($SA_{P1}$), the second piston surface area ($SA_{P2}$), and the fluid flow path making the longitudinal valve insensitive to tubing pressure.

C. A method, the method including: 1) lowering a subsurface safety valve via a conveyance into a wellbore, the subsurface safety valve including: a) a tubular housing having a first tubular housing end, a second tubular housing end, and a longitudinal opening extending at least partially from the first tubular housing end toward the second tubular housing end, the tubular housing having an inside diameter, an outside diameter, and a wall thickness (t); b) one or more openings extending through the wall thickness (t) proximate the first tubular housing end, the one or more openings configured to provide a fluid path for wellbore fluids to flow into and through the tubular housing and uphole into a production tubular; and c) a longitudinal valve having a first longitudinal valve end and a second longitudinal valve end positioned within the longitudinal opening, the longitudinal valve configured to move between a closed state preventing the one or more openings from providing the fluid path for wellbore fluids to flow into and through the tubular housing and uphole into the production tubular and an open state allowing the one or more openings to provide the fluid path for the wellbore fluids to flow into and through the tubular housing and uphole into the production tubular, the longitudinal valve including: i) a first piston having a first piston surface area ($SA_{P1}$), the first piston located more proximate the first longitudinal valve end than the second longitudinal valve end and configured to slide upon a first piston surface of the tubular housing as the longitudinal valve moves between the closed state and the open state; ii) a second piston having a second piston surface area ($SA_{P2}$), the second piston located more near the second longitudinal valve end than the first longitudinal valve end and configured to slide upon a second piston surface of the tubular housing as the longitudinal valve moves between the closed state and the open state, the first piston surface area ($SA_{P1}$) and the second piston surface area ($SA_{P2}$) being substantially identical; and iii) a fluid flow path extending within and along the longitudinal valve, the fluid flow path entering the longitudinal valve between the first longitudinal valve end and the first piston and exiting the longitudinal valve between the second longitudinal valve end and the second piston, the first piston surface area ($SA_{P1}$), the second piston surface area ($SA_{P2}$), and the fluid flow path making the longitudinal valve insensitive to tubing pressure; and 2) applying a control fluid signal to the longitudinal valve, the control fluid signal being insensitive to the tubing pressure.

Aspects A, B, and C may have one or more of the following additional elements in combination: Element 1: further including a power spring located within the longitudinal opening, the power spring engaging a radially extending portion of the longitudinal valve and a power spring shoulder of the tubular housing, the power spring configured to urge the longitudinal valve toward the closed state. Element 2: wherein the radially extending portion is a third piston have a third piston surface area ($SA_{P3}$), the third piston located between the first piston and the second piston and configured to slide upon a third piston surface of the tubular housing as the longitudinal valve moves between the closed state and the open state. Element 3: wherein the third piston surface area ($SA_{P3}$) is greater than the first piston surface area ($SA_{P1}$) and the second piston surface area ($SA_{P2}$). Element 4: wherein the third piston surface area ($SA_{P3}$) is at least 25 percent greater than the first piston surface area ($SA_{P1}$) and the second piston surface area ($SA_{P2}$). Element 5: wherein the third piston surface area ($SA_{P3}$) is at least 50 percent greater than the first piston surface area ($SA_{P1}$) and the second piston surface area ($SA_{P2}$). Element 6: wherein the third piston surface area ($SA_{P3}$) is at least 100 percent greater than the first piston surface area ($SA_{P1}$) and the second piston surface area ($SA_{P2}$). Element 7: further including a control line opening extending at least partially along and through the wall thickness (t) of the tubular housing and entering the longitudinal opening between the first piston and the third piston, the control line opening configured to provide control line pressure to the third piston to oppose the power spring and move the longitudinal valve between the closed state and the open state. Element 8: further including a detent mechanism positioned within the longitudinal tubular proximate where the fluid flow path exits the longitudinal valve, the detent mechanism configured to releasably hold the longitudinal valve in the open state. Element 9: wherein the detent mechanism includes a detent spacer, a detent spring positioned between the detent spacer and a first detent shoulder of the tubular housing, and one or more detent balls slidable coupled with the detent spacer, the one or more detent balls configured to: a) remain within a first axial and first radial position engaged with a second detent shoulder of the tubular housing when the longitudinal valve is the in the closed state; b) ride upon the longitudinal valve as the longitudinal valve moves from the closed state to the open state while remaining within the first axial and first radial position; and c) release from the second detent shoulder and move to a second different axial and second different radial position engaged with a smaller outside diameter of the longitudinal valve when the longitudinal valve reaches the open state, the one or more detent balls engaged with the smaller outside diameter of the longitudinal valve to releasably hold the longitudinal valve in the open state. Element 10: wherein the subsurface safety valve is a wireline retrievable subsurface safety valve, and further including a tubing retrievable subsurface safety valve located within the wellbore. Element 11: wherein the wireline retrievable subsurface safety valve is at least partially positioned within the tubing retrievable subsurface safety valve.

Those skilled in the art to which this application relates will appreciate that other and further additions, deletions, substitutions and modifications may be made to the described embodiments.

What is claimed is:

1. A subsurface safety valve, comprising:

a tubular housing having a first tubular housing end, a second tubular housing end, and a longitudinal opening extending at least partially from the first tubular housing end toward the second tubular housing end, the tubular housing having an inside diameter, an outside diameter, and a wall thickness (t);

one or more openings extending through the wall thickness (t) proximate the first tubular housing end, the one or more openings configured to provide a fluid path for wellbore fluids to flow into and through the tubular housing and uphole into a production tubular; and a longitudinal valve having a first longitudinal valve end and a second longitudinal valve end positioned within the longitudinal opening, the longitudinal valve configured to move between a closed state preventing the one or more openings from providing the fluid path for wellbore fluids to flow into and through the tubular housing and uphole into the production tubular and an open state allowing the one or more openings to provide the fluid path for the wellbore fluids to flow into and through the tubular housing and uphole into the production tubular, the longitudinal valve including:

a first piston having a first piston surface area ($SA_{P1}$), the first piston located more proximate the first longitudinal valve end than the second longitudinal valve end and configured to slide upon a first piston surface of the tubular housing as the longitudinal valve moves between the closed state and the open state;

a second piston having a second piston surface area ($SA_{P2}$), the second piston located more near the second longitudinal valve end than the first longitudinal valve end and configured to slide upon a second piston surface of the tubular housing as the longitudinal valve moves between the closed state and the open state, the first piston surface area ($SA_{P1}$) and the second piston surface area ($SA_{P2}$) being substantially identical; and a fluid flow path extending within and along the longitudinal valve, the fluid flow path entering the longitudinal valve between the first longitudinal valve end and the first piston and exiting the longitudinal valve between the second longitudinal valve end and the second piston, the first piston surface area ($SA_{P1}$), the second piston surface area ($SA_{P2}$), and the fluid flow path making the longitudinal valve insensitive to tubing pressure.

2. The subsurface safety valve as recited in claim 1, further including a power spring located within the longitudinal opening, the power spring engaging a radially extending portion of the longitudinal valve and a power spring shoulder of the tubular housing, the power spring configured to urge the longitudinal valve toward the closed state.

3. The subsurface safety valve as recited in claim 2, wherein the radially extending portion is a third piston have a third piston surface area ($SA_{P3}$), the third piston located between the first piston and the second piston and configured to slide upon a third piston surface of the tubular housing as the longitudinal valve moves between the closed state and the open state.

4. The subsurface safety valve as recited in claim 3, wherein the third piston surface area ($SA_{P3}$) is greater than the first piston surface area ($SA_{P1}$) and the second piston surface area ($SA_{P2}$).

5. The subsurface safety valve as recited in claim 3, wherein the third piston surface area ($SA_{P3}$) is at least 25 percent greater than the first piston surface area ($SA_{P1}$) and the second piston surface area ($SA_{P2}$).

6. The subsurface safety valve as recited in claim 3, wherein the third piston surface area ($SA_{P3}$) is at least 50 percent greater than the first piston surface area ($SA_{P1}$) and the second piston surface area ($SA_{P2}$).

7. The subsurface safety valve as recited in claim 3, wherein the third piston surface area ($SA_{P3}$) is at least 100 percent greater than the first piston surface area ($SA_{P1}$) and the second piston surface area ($SA_{P2}$).

8. The subsurface safety valve as recited in claim 3, further including a control line opening extending at least partially along and through the wall thickness (t) of the tubular housing and entering the longitudinal opening between the first piston and the third piston, the control line opening configured to provide control line pressure to the third piston to oppose the power spring and move the longitudinal valve between the closed state and the open state.

9. The subsurface safety valve as recited in claim 3, further including a detent mechanism positioned within the longitudinal tubular proximate where the fluid flow path exits the longitudinal valve, the detent mechanism configured to releasably hold the longitudinal valve in the open state.

10. The subsurface safety valve as recited in claim 9, wherein the detent mechanism includes a detent spacer, a detent spring positioned between the detent spacer and a first detent shoulder of the tubular housing, and one or more detent balls slidable coupled with the detent spacer, the one or more detent balls configured to:

remain within a first axial and first radial position engaged with a second detent shoulder of the tubular housing when the longitudinal valve is the in the closed state;

ride upon the longitudinal valve as the longitudinal valve moves from the closed state to the open state while remaining within the first axial and first radial position; and release from the second detent shoulder and move to a second different axial and second different radial position engaged with a smaller outside diameter of the longitudinal valve when the longitudinal valve reaches the open state, the one or more detent balls engaged with the smaller outside diameter of the longitudinal valve to releasably hold the longitudinal valve in the open state.

11. A well system, comprising:

a wellbore extending through one or more subterranean formations; and a subsurface safety valve located in the wellbore, the subsurface safety valve including:

a tubular housing having a first tubular housing end, a second tubular housing end, and a longitudinal opening extending at least partially from the first tubular housing end toward the second tubular housing end, the tubular housing having an inside diameter, an outside diameter, and a wall thickness (t);

one or more openings extending through the wall thickness (t) proximate the first tubular housing end, the one or more openings configured to provide a fluid path for wellbore fluids to flow into and through the tubular housing and uphole into a production tubular; and a longitudinal valve having a first longitudinal valve end and a second longitudinal valve end positioned within the longitudinal opening, the longitudinal valve configured to move between a closed state preventing the one or more openings from providing the fluid path for wellbore fluids to flow into and through the tubular housing and uphole into the production tubular and an open state allowing the one or more openings to provide the fluid path for the wellbore fluids to flow into and through the tubular housing and uphole into the production tubular, the longitudinal valve including:

a first piston having a first piston surface area ($SA_{P1}$), the first piston located more proximate the first longitudinal valve end than the second longitudinal valve end and configured to slide upon a first piston surface of the tubular housing as the longitudinal valve moves between the closed state and the open state;

a second piston having a second piston surface area ($SA_{P2}$), the second piston located more near the second longitudinal valve end than the first longitudinal valve end and configured to slide upon a second piston surface of the tubular housing as the longitudinal valve moves between the closed state and the open state, the first piston surface area ($SA_{P1}$) and the second piston surface area ($SA_{P2}$) being substantially identical; and a fluid flow path extending within and along the longitudinal valve, the fluid flow path entering the longitudinal valve between the first longitudinal valve end and the first piston and exiting the longitudinal valve between the second longitudinal valve end and the second piston, the first piston surface area ($SA_{P1}$), the second piston surface area ($SA_{P2}$), and the fluid flow path making the longitudinal valve insensitive to tubing pressure.

12. The well system as recited in claim 11, wherein the subsurface safety valve is a wireline retrievable subsurface safety valve, and further including a tubing retrievable subsurface safety valve located within the wellbore.

13. The well system as recited in claim 12, wherein the wireline retrievable subsurface safety valve is at least partially positioned within the tubing retrievable subsurface safety valve.

14. The well system as recited in claim 11, further including a power spring located within the longitudinal opening, the power spring engaging a radially extending portion of the longitudinal valve and a power spring shoulder of the tubular housing, the power spring configured to urge the longitudinal valve toward the closed state.

15. The well system as recited in claim 14, wherein the radially extending portion is a third piston have a third piston surface area ($SA_{P3}$), the third piston located between the first piston and the second piston and configured to slide upon a third piston surface of the tubular housing as the longitudinal valve moves between the closed state and the open state.

16. The well system as recited in claim 15, wherein the third piston surface area ($SA_{P3}$) is greater than the first piston surface area ($SA_{P1}$) and the second piston surface area ($SA_{P2}$).

17. The well system as recited in claim 15, wherein the third piston surface area ($SA_{P3}$) is at least 100 percent greater than the first piston surface area ($SA_{P1}$) and the second piston surface area ($SA_{P2}$).

18. The well system as recited in claim 15, further including a control line opening extending at least partially along and through the wall thickness (t) of the tubular housing and entering the longitudinal opening between the first piston and the third piston, the control line opening configured to provide control line pressure to the third piston to oppose the power spring and move the longitudinal valve between the closed state and the open state.

19. The well system as recited in claim 15, further including a detent mechanism positioned within the longitudinal tubular proximate where the fluid flow path exits the longitudinal valve, the detent mechanism configured to releasably hold the longitudinal valve in the open state.

20. The well system as recited in claim 19, wherein the detent mechanism includes a detent spacer, a detent spring positioned between the detent spacer and a first detent shoulder of the tubular housing, and one or more detent balls slidable coupled with the detent spacer, the one or more detent balls configured to:

remain within a first axial and first radial position engaged with a second detent shoulder of the tubular housing when the longitudinal valve is the in the closed state;

ride upon the longitudinal valve as the longitudinal valve moves from the closed state to the open state while remaining within the first axial and first radial position; and release from the second detent shoulder and move to a second different axial and second different radial position engaged with a smaller outside diameter of the longitudinal valve when the longitudinal valve reaches the open state, the one or more detent balls engaged with the smaller outside diameter of the longitudinal valve to releasably hold the longitudinal valve in the open state.

21. A method, comprising:

lowering a subsurface safety valve via a conveyance into a wellbore, the subsurface safety valve including:

a tubular housing having a first tubular housing end, a second tubular housing end, and a longitudinal opening extending at least partially from the first tubular housing end toward the second tubular housing end, the tubular housing having an inside diameter, an outside diameter, and a wall thickness (t);

one or more openings extending through the wall thickness (t) proximate the first tubular housing end, the one or more openings configured to provide a fluid path for wellbore fluids to flow into and through the tubular housing and uphole into a production tubular; and a longitudinal valve having a first longitudinal valve end and a second longitudinal valve end positioned within the longitudinal opening, the longitudinal valve configured to move between a closed state preventing the one or more openings from providing the fluid path for wellbore fluids to flow into and through the tubular housing and uphole into the production tubular and an open state allowing the one or more openings to provide the fluid path for the wellbore fluids to flow into and through the tubular housing and uphole into the production tubular, the longitudinal valve including:

a first piston having a first piston surface area ($SA_{P1}$), the first piston located more proximate the first longitudinal valve end than the second longitudinal valve end and configured to slide upon a first piston surface of the tubular housing as the longitudinal valve moves between the closed state and the open state;

a second piston having a second piston surface area ($SA_{P2}$), the second piston located more near the second longitudinal valve end than the first longitudinal valve end and configured to slide upon a second piston surface of the tubular housing as the longitudinal valve moves between the closed state and the open state, the first piston surface area ($SA_{P1}$) and the second piston surface area ($SA_{P2}$) being substantially identical; and a fluid flow path extending within and along the longitudinal valve, the fluid flow path entering the longitudinal valve between the first longitudinal valve end and the first piston and exiting the longitudinal valve between the second longitudinal valve end and the second piston, the first piston surface area ($SA_{P1}$), the second piston surface area ($SA_{P2}$), and the fluid flow path making the longitudinal valve insensitive to tubing pressure; and applying a control fluid signal to the longitudinal valve, the control fluid signal being insensitive to the tubing pressure.

* * * * *